US011154743B2

(12) United States Patent
Chen

(10) Patent No.: US 11,154,743 B2
(45) Date of Patent: Oct. 26, 2021

(54) WEIGHT DELAY DEVICE FOR WEIGHT TRAINING EQUIPMENT

(71) Applicant: HEALTHSTREAM TAIWAN INC., Taoyuan (TW)

(72) Inventor: Chun-Ting Chen, Taoyuan (TW)

(73) Assignee: HFALTHSTREAM TAIWAN INC., Taoyuan (TW)

( * ) Notice: Subject to any disclaimer, the term of this patent is extended or adjusted under 35 U.S.C. 154(b) by 0 days.

(21) Appl. No.: 17/034,062

(22) Filed: Sep. 28, 2020

(65) Prior Publication Data

US 2021/0128968 A1 May 6, 2021

(30) Foreign Application Priority Data

Oct. 31, 2019 (TW) ..... 108139534

(51) Int. Cl.
*A63B 21/062* (2006.01)

(52) U.S. Cl.
CPC ..... *A63B 21/063* (2015.10)

(58) Field of Classification Search
CPC ..... A63B 21/063; A63B 21/06; A63B 21/062–0632; A63B 21/00058; A63B 21/00065; A63B 21/00069
See application file for complete search history.

(56) References Cited

U.S. PATENT DOCUMENTS 7,413,532 B1 * 8/2008 Monsrud ..... A63B 21/0628 482/98
9,604,090 B1 * 3/2017 Meyer ..... A63B 21/0626
2005/0176559 A1 * 8/2005 Carter ..... A63B 21/063 482/94
2016/0074688 A1 * 3/2016 Leipheimer ..... A63B 21/00069 482/98

* cited by examiner

*Primary Examiner* — Jennifer Robertson
*Assistant Examiner* — Catrina A Letterman
(74) *Attorney, Agent, or Firm* — Muncy, Geissler, Olds & Lowe, P.C.

(57) ABSTRACT

A weight delay device for weight training equipment includes a delay member vertically movable between a second top dead point and a second bottom dead point, and a locking assembly vertically movable with the main weight device of the weight training equipment and having a positioning member selectively locatable at a first position or a second position. When the positioning member is located at the second position and the main weight device starts to move from the first bottom dead point to the first top dead point, the positioning member and the delay member are combined with each other, so that the delay member moves with the main weight device to the first top dead point.

4 Claims, 8 Drawing Sheets

WEIGHT DELAY DEVICE FOR WEIGHT TRAINING EQUIPMENT

BACKGROUND OF THE INVENTION

1. Field of the Invention

The present invention relates to weight training equipment, and more particularly to a weight delay device for weight training equipment.

2. Description of the Related Art

Most of the fitness exercises of weight training use pulling weight pieces to produce weight-bearing training effects. Pulling different numbers of weight pieces can change different loads and achieve enhanced training intensity and variability training effects.

In addition to achieving different training effects through different loads, weight training will also match different operating mechanisms or operating methods to achieve the purpose of exercising different muscle groups.

However, the above-mentioned muscle exercise methods of weight training are relatively monotonous and cannot further increase the exercise effect.

SUMMARY OF THE INVENTION

The present invention has been accomplished under the circumstances in view. It s the main object of the present invention to provide a weight delay device for weight training equipment, which can improve the muscle movement of centripetal contraction and eccentric contraction, increase the muscle movement effect, and strengthen the training intensity.

To achieve this and other objects of the present invention, a weight delay device provided by the present invention is for use in a weight training equipment that comprises a main weight device movable up and down in a vertical direction between a first top dead point and a first bottom dead point. The weight delay device comprises a delay member and a locking assembly. The delay member is set adjacent to the main weight device by moving between a second top dead point and a second bottom dead point along the vertical direction. The height of the second top dead point is not lower than the first top dead point. The height of the second bottom dead point is higher than said first bottom dead point. The locking assembly comprises a positioning member. The positioning member is selectively set in a first position or a second position. The locking assembly is set on the main weight device and movable up and down with the main weight device. When the positioning member is located at the first position, the positioning member is separated from the delay member. When the positioning member is located at the second position and the main weight device starts to move from the first bottom dead point to the first top dead point, the positioning member and the delay member are combined with each other, so that the delay member moves with the main weight device to the first top dead point. When the main weight device moves from the first top dead point to the first bottom dead point, the delay member first moves with the main weight device to the second bottom dead point and then stops moving, and then the main weight device moves to the first bottom dead point. In turn, it achieves the purpose of improving the muscle movement of concentric contraction and eccentric contraction, increasing the effect of muscle movement and strengthening the training intensity.

Preferably, the delay member comprises an elongated slot in the center thereof, and a position-limiting portion at a top end of the elongated slot. When the positioning member is located at the first position, the positioning member is separated from the delay member. When the positioning member is located at the second position, the end of the positioning member is inserted into the elongated slot of the delay member corresponding to the position-limiting portion, Preferably, the weight delay device further comprises a position limiter. When the positioning member is pressed once from the first position to the second position, the positioning member is combined with the position limiter and continues to be positioned at the second position. When the positioning member is pressed again, the position limiter releases the positioning member and the positioning member moves from the second position back to the first position.

Preferably, the positioning member uses a spring to provide an elastic restoring force required for the positioning member to return to the position between the first position and the second position.

Preferably, the second bottom dead point is a stopper.

The detailed structure or features provided by the present invention will be described in the detailed description of the subsequent implementation. However, those skilled in the art should be able to understand that the detailed description and the specific examples for implementing the present invention are only used to illustrate the present invention, it is not intended to limit the scope of protection of the claims of the present invention.

DETAILED DESCRIPTION OF THE INVENTION

Figure 1:
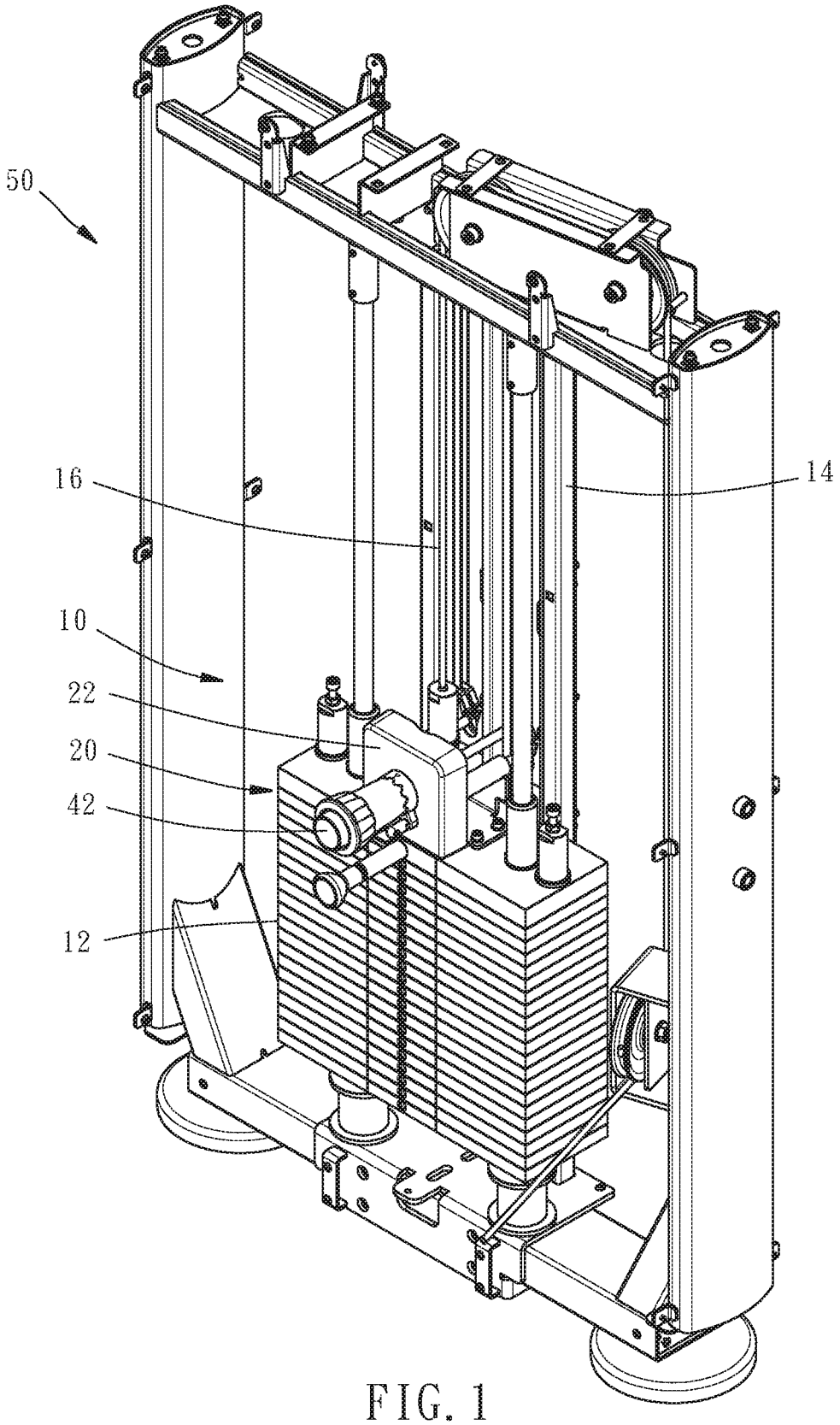
FIG 1 is an oblique top elevational view of the present invention.
Figure 2:
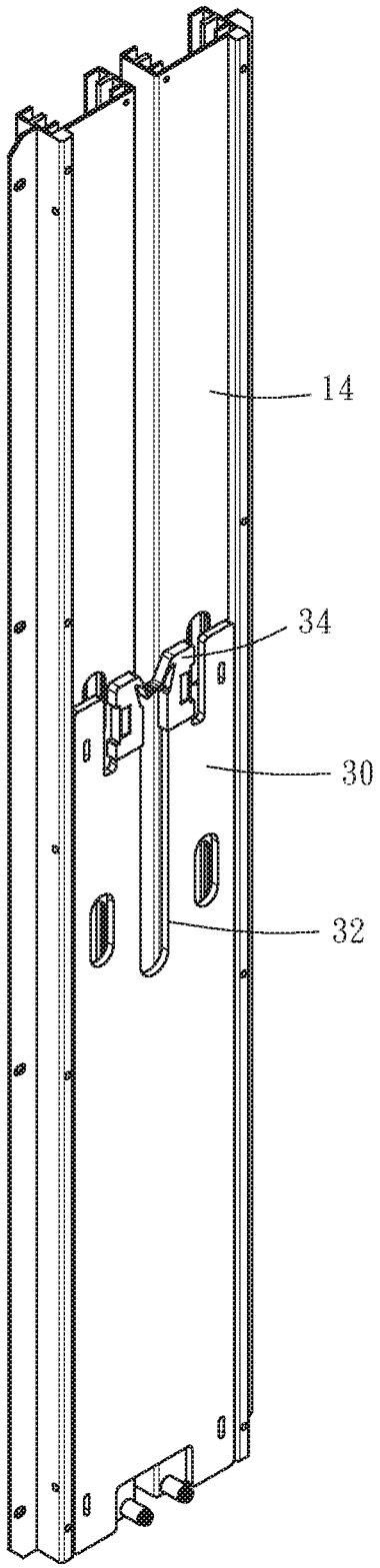
FIG. 2 is an elevational view, in an enlarged scale, of a part of the present invention.
Figure 3:
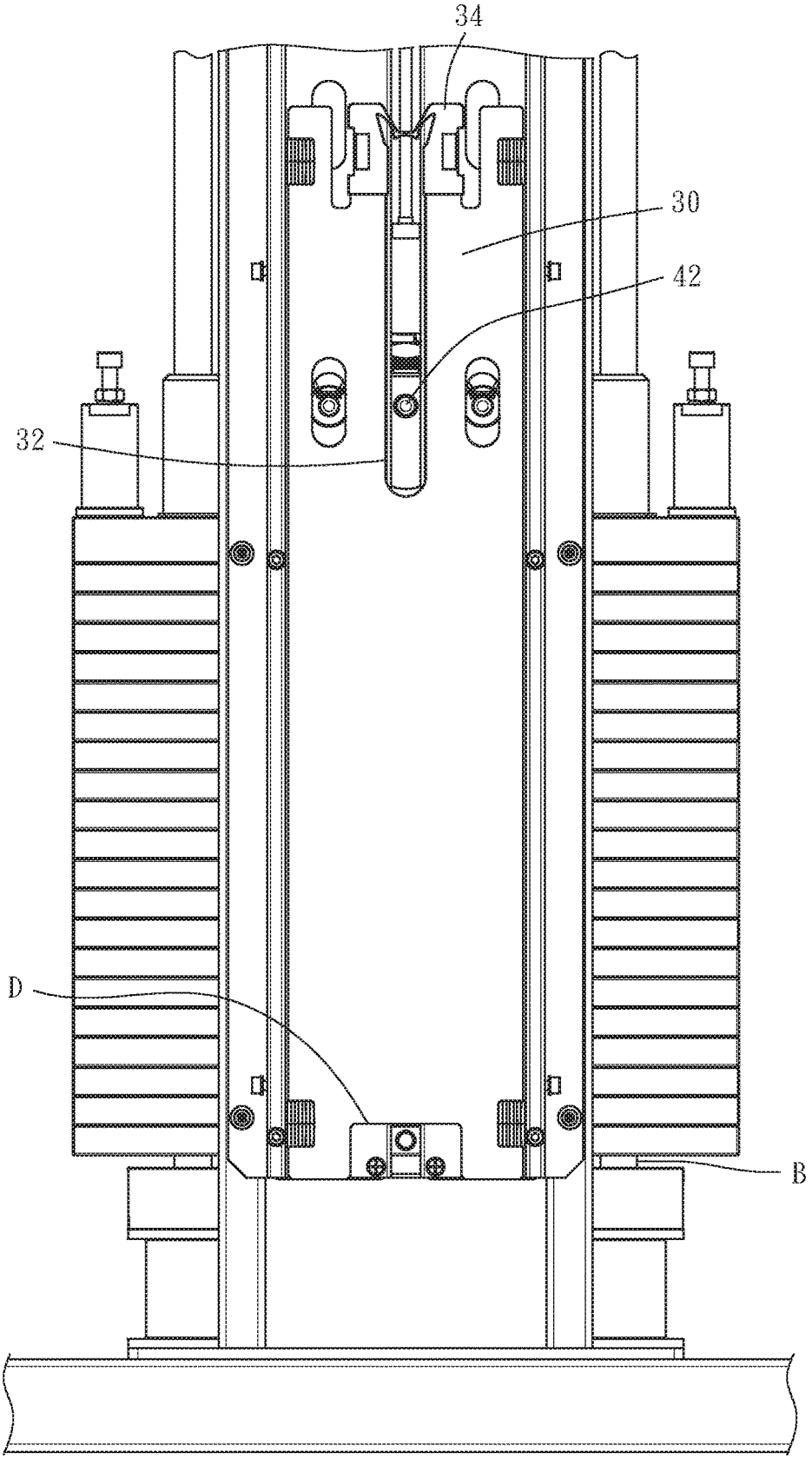
FIG. 3 is a rear side view of a part of the present invention.
Figure 4:
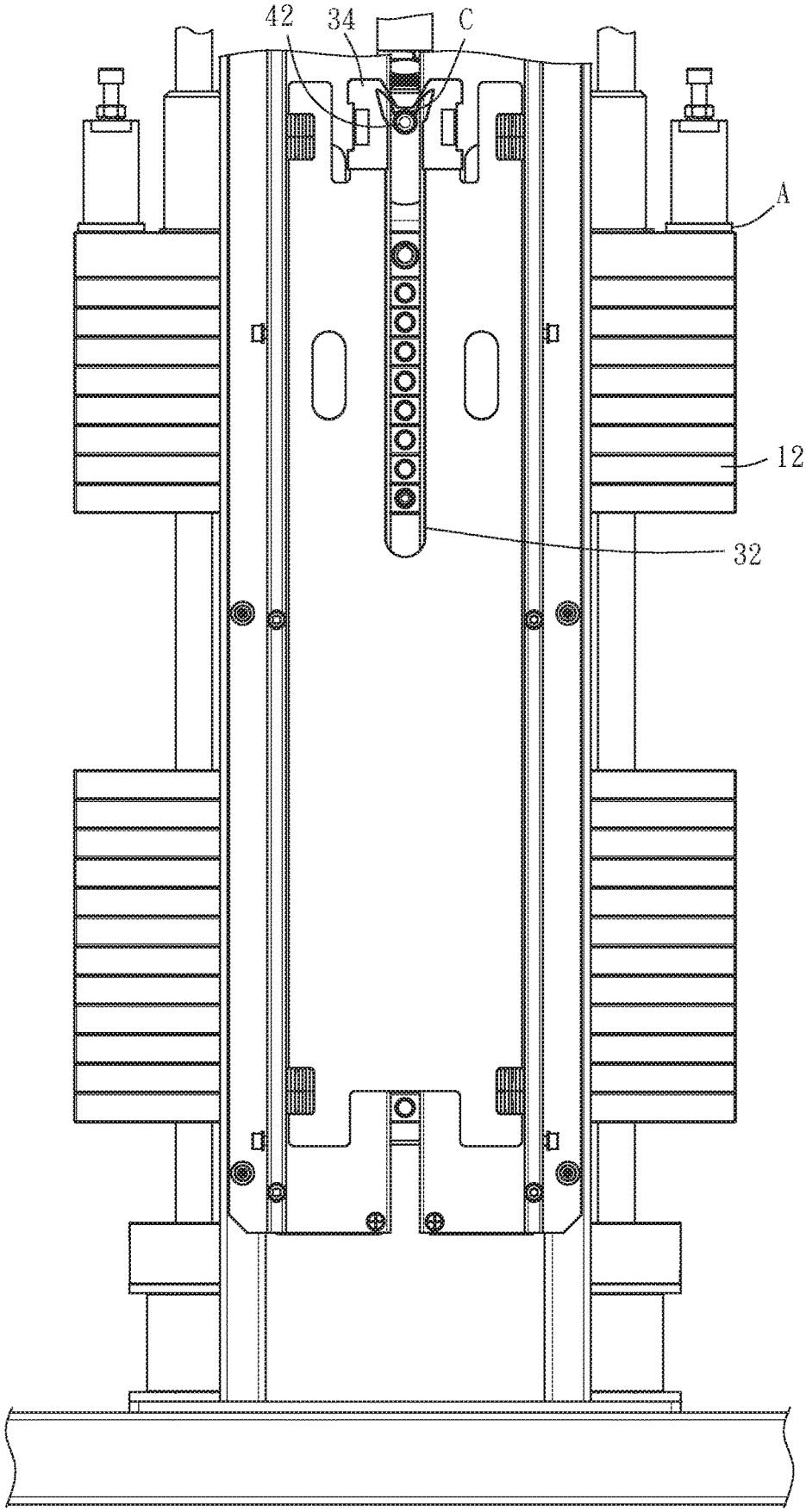
FIG. 4 is similar to FIG. 3, mainly showing the main weight device in the first top dead point with the delay member.

Hereinafter, the technical content and features of the present invention will be described in detail by enumerating preferred embodiments with drawings. The weight delay device of weight training equipment provided by the present invention can be widely used in various fitness equipment with weight training boxes. Those skilled in the art can understand that the explanatory terms of this embodiment belong to the upper-level description that does not limit the application field. For example, the material or shape terms include but are not limited to the material or shape specified by the description content, and the position terms include but are not limited to setting, proximity, connect, or adjacency. The term "one" for the quantity of each component includes One ore than one component quantity. The directional adjectives mentioned in the content of this specification, such as "upper", "lower", "inner", "outer", "top", "bottom", etc. are only exemplary descriptions based on the normal direction of use and are not intended to limit the scope of claims.

Referring to FIGS. 1-4, a preferred embodiment of the present invention takes a weight training equipment with a weight training box 50 as an example. The weight training box 50 has a main weight device 10. The main weight device 10 includes a plurality of main weight pieces 12 stacked on each other and is provided with a vertically extending guide rail 14. The main weight pieces 12 can move up and down between a first top dead point A (see FIG. 4) and a first bottom dead point B (see FIG. 3) with the drive of a steel cable 16.

The main weight device 10 is equipped with an auxiliary weight adjusting device 0. The auxiliary weight adjusting device 20 comprises a selector 22 at the top of the main weight device 10.

The weight delay device provided by the present invention comprises a delay member 30 and a locking assembly 40. In the present preferred embodiment, the delay member 30 is an elongated sheet member as an example, the center of the delay member 30 has an elongated slot 32, and the delay member 30 is provided with a position-limiting portion 34 at the top of the slot 32. The delay member 30 is set in the guide rail 14 adjacent to the main weight device 10. The delay member 30 is vertically movable between a second top dead point C (see FIG. 4) and a second bottom dead point D (see FIG. 3), The height of the second top dead point C is not lower than the first top dead point A of the main weight device 10. The height of the second bottom dead point D is higher than the first bottom dead point B of the main weight device 10. The second bottom dead point D in the present preferred embodiment is a stopper provided at the bottom of the guide rail 14 as an example.

Figure 5:
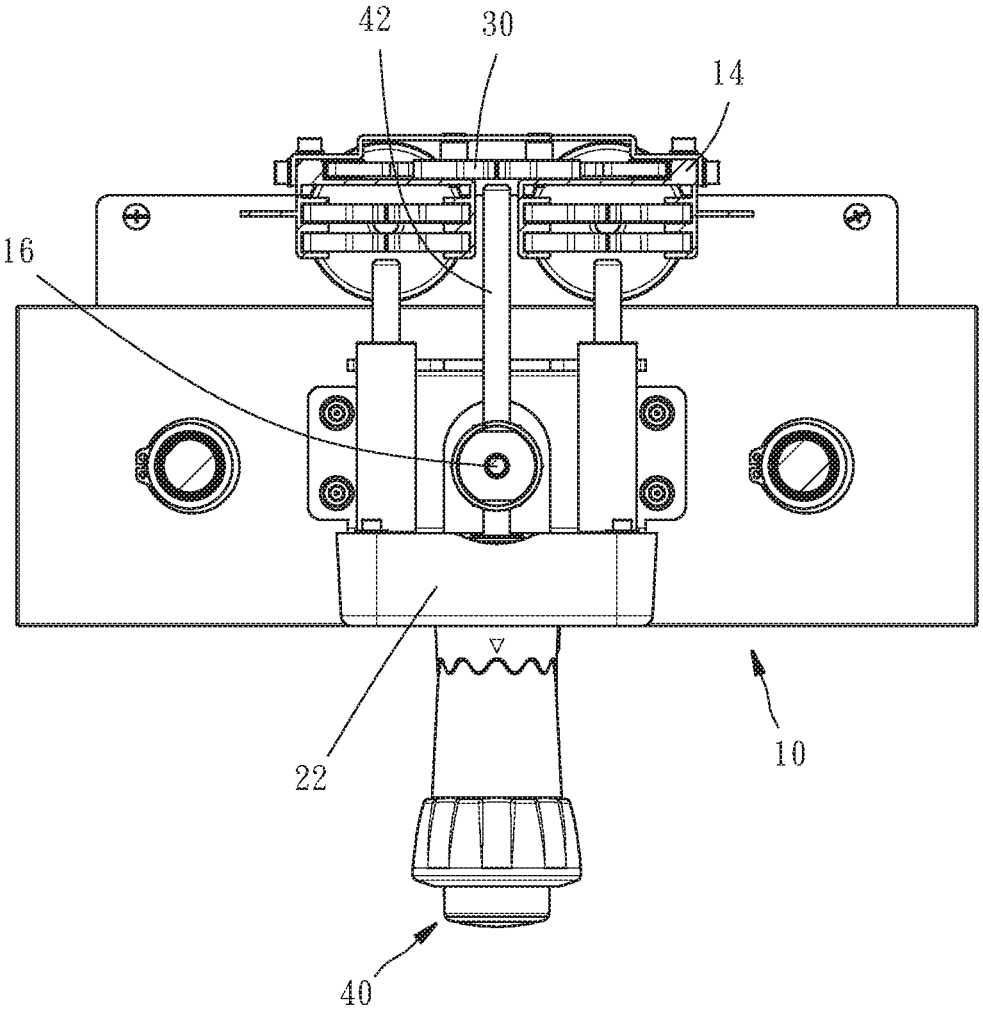
FIG. 5 is a top view of a part of the present invention.
Figure 6:
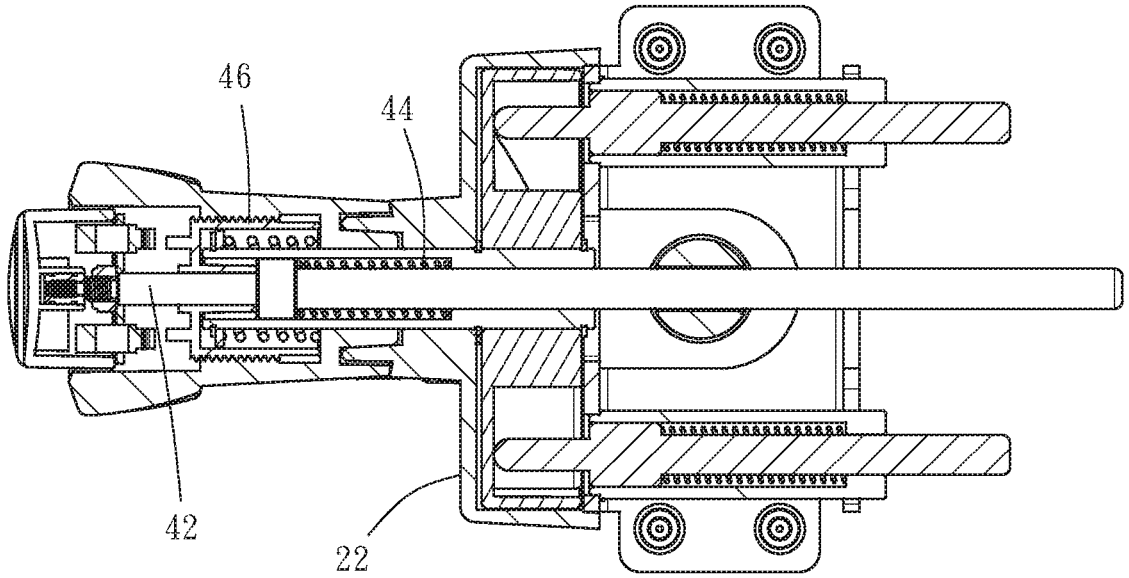
FIG. 6 is a sectional view of a part of the present invention.
Figure 7:
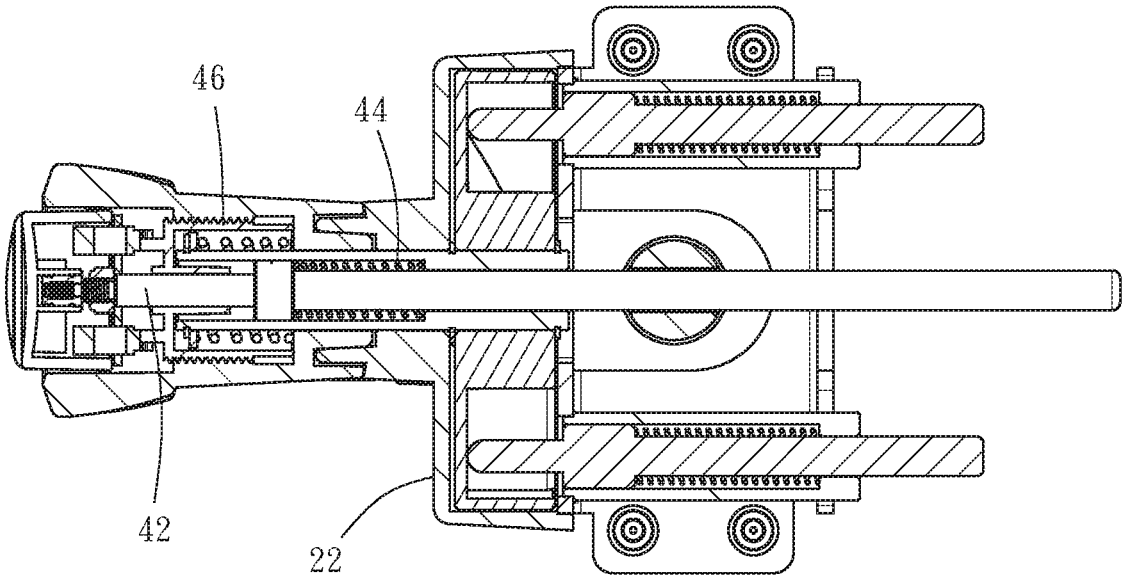
FIG. 7 is similar to FIG. 6, mainly showing the positioning member in the second position.
Figure 8:
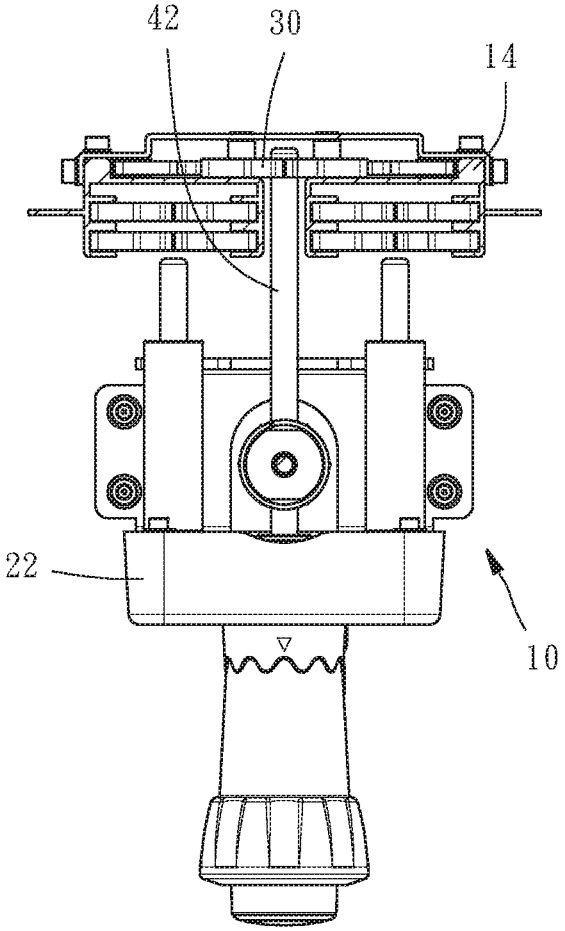
FIG. 8 is a sectional view of a part of the present invention, mainly showing the positioning member in the second position.

The locking assembly 40 comprises a positioning member 42. The positioning member 42 in the present preferred embodiment is movably passed through the center of the selector 22 of the auxiliary weight adjusting device 20. The locking assembly 40 moves up and down with the auxiliary weight adjusting device 20 and the main weight device 10. The positioning member 42 is movable back and forth between a first position (see FIG. 5 and FIG. 6) and a second position (see FIG. 7 and FIG. 8). When the positioning member 42 is in the first position, the positioning member 42 is separated from the delay member 30. When the positioning member 42 is in the second position, the end of the positioning member 42 is inserted into the elongated slot 32 of the delay member 30. A spring 44 is provided between the positioning member 42 and the selector 22 to provide an elastic restoring force required for the positioning member 42 to return to the position between the first position and the second position. There is a position limiter 46 provided in the selector 22. The position limiter 46 in the present preferred embodiment is a one-touch catch as an example. If the positioning member 42 is pressed once from the first position to the second position, the positioning member 42 can continue to be positioned at the second position due to being combined with the position limiter 46. If the positioning member 42 is pressed again, through the function of the spring inside the position limiter 46, the positioning member 42 will move from the second position back to the first position.

Figure 9:
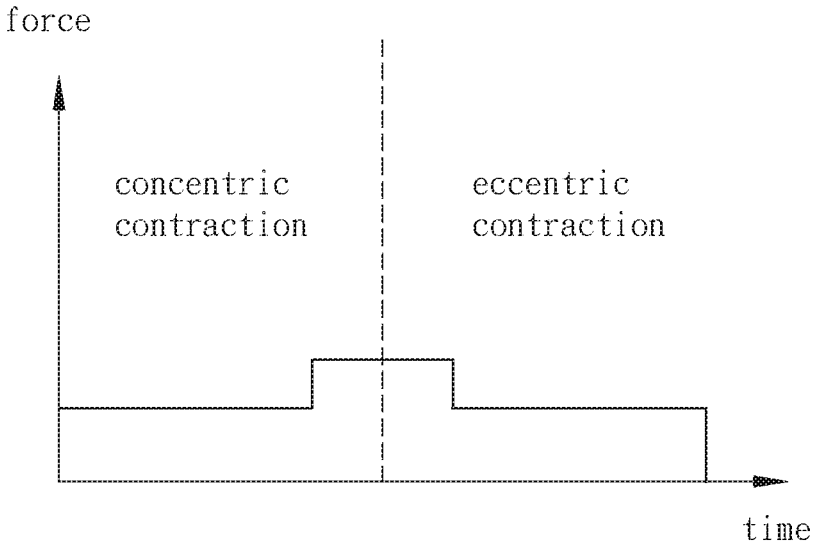
FIG. 9 is a graph of muscle exercise intensity of the preferred embodiment of the present invention.

In this way, if the weight delay device of the present invention is needed for weight training, the user can first press the positioning member 42 to the second position once, so that the end of the positioning member 42 extends into the elongated slot 32 of the delay member 30. When the main weight device 10 is pulled to move a predetermined distance from the first bottom dead point B toward the first top dead point A, the positioning member 42 moves with the auxiliary weight adjusting device 20 and then is combined with the position-limiting portion 34 of the delay member 30 so that the delay member 30 starts to move to first top dead point A along with main weight device 10 before stopping. At the beginning of the motion load, only the weight of the main weight piece 12 is used, and the weight of the delay member 30 is increased until the positioning member 42 drives the delay member 30 to move together. This part is shown in FIG. 9 to increase the strength of the muscle's centripetal contraction.

When the main weight device 10 moves from the first top dead point A back to the first bottom dead point B. the delay member 30 moves down synchronously with the main weight device 10 until it moves to the second bottom dead point D, and then the main weight device is moved to first bottom dead point B separately. The exercise load of this part will first include the heavier weight of the main weight piece 12 and the delay member 30, until the delay member 30 no longer moves, only the lighter weight of the main weight device 10 is included, thereby increasing the eccentric contraction of the muscle strength. The delay member 30 can be used alone or in conjunction with the auxiliary weight pieces 26 to further increase the training intensity and richness.

Through the components of the above weight delay device, the present invention increases the intensity of the centripetal contraction and eccentric contraction during weight training, so that weight training is not only a single weight bearing, but can produce changes in the weight during the exercise, achieving the effect of increasing muscle movement and strengthening training intensity.

What is claimed is:

1. A weight delay device for use in a weight training equipment, said weight training equipment comprising a main weight device movable up and down in a vertical direction between a first top dead point and a first bottom dead point, said weight delay device comprising:

a delay member set adjacent to said main weight device by moving between a second top dead point and a second bottom dead point along said vertical direction, the height of said second top dead point being equal to or above said first top dead point, the height of said second bottom dead point being higher than said first bottom dead point; and a locking assembly comprising a positioning member, said positioning member being selectively set in a first position or a second position, said locking assembly being set on said main weight device and movable up and down with said main weight device;

wherein: when said positioning member is located at said first position, said positioning member is separated from said delay member; when said positioning member is located at said second position and said main weight device starts to move from said first bottom dead point to said first top dead point, said positioning member and said delay member are combined with each other, so that said delay member moves with said main weight device to said first top dead point; when said main weight device moves from said first top dead point to said first bottom dead point, said delay member first moves with said main weight device to said second bottom dead point and then stops moving, and then said main weight device moves to said first bottom dead point.

2. The weight delay device as claimed in claim 1, wherein said delay member comprises an elongated slot in the center thereof, and a position-limiting portion at a top end of said elongated slot; when said positioning member is located at said first position, said positioning member is separated from said delay member; when said positioning member is located at said second position, an end of said positioning member is inserted into said elongated slot of said delay member corresponding to said position-limiting portion.

3. The weight delay device as claimed in claim 1, further comprising a position limiter, wherein when said positioning member is pressed once from said first position to said second position, said positioning member is combined with said position limiter and continues to be positioned at said second position; when said positioning. member is pressed again, said position limiter releases said positioning member and said positioning member moves from said second position back to said first position.

4. The weight delay device as claimed in claim 1, wherein said positioning member uses a spring to provide an elastic restoring force required for said positioning member to return to the position between said first position and said second position.

* * * * *